United States Patent [19]

Melvin

[11] Patent Number: 4,651,961

[45] Date of Patent: Mar. 24, 1987

[54] SUSPENSION OF OBJECTS

[76] Inventor: Thomas E. Melvin, Rte. 1, Box 90B, Rod Run, Va. 22014

[21] Appl. No.: 650,837

[22] Filed: Sep. 17, 1984

[51] Int. Cl.[4] ..... A47G 29/00

[52] U.S. Cl. ..... 248/293; 211/48; 211/116; 211/169.1

[58] Field of Search ..... 248/293, 294, 308; 211/169.1, 170, 8, 48, 47, 116, 118

[56] References Cited

U.S. PATENT DOCUMENTS

| | | | |
|---|---|---|---|
| 1,461,938 | 7/1923 | Rose | 248/294 |
| 1,545,122 | 7/1925 | Brown | 211/106 X |
| 2,071,257 | 2/1937 | Hansen | 248/293 X |
| 2,602,622 | 7/1952 | Smith | 248/293 |
| 3,295,696 | 1/1967 | Cohen | 211/47 X |
| 4,221,354 | 9/1980 | Kempkers | 248/308 X |

*Primary Examiner*—J. Franklin Foss
*Assistant Examiner*—David L. Talbott
*Attorney, Agent, or Firm*—George E. Kersey

[57] ABSTRACT

A longitudinally extending, or extendable, member is pivotally positioned within a housing. The member includes a protuberence at the pivot position to facilitate the pivoting of the member outwardly from the housing into a position for receiving an item that is to be suspended by the member. In accordance with one aspect of the invention, the housing is a frame with a rectangular opening that receives the longitudinally extending or extendable member. The latter desirably has a rectangular cross section in its longitudinal direction and is similar in its rectangularity to that of the opening in the housing within which it is pivotally positioned. In accordance with another aspect of the invention, a plurality of nested members are includable within the housing at the pivot position. In one form of nesting, a central member is bridged by adjoining legs which are in turn joined by the bridge. This configuration permits an item that is to be suspended to be trapped between the members and thereby restricted from accidental dislodgement at the suspension position. In effect, the suspension members can be pivoted outwardly from the housing and used like a clamp to secure the item being suspended.

18 Claims, 4 Drawing Figures

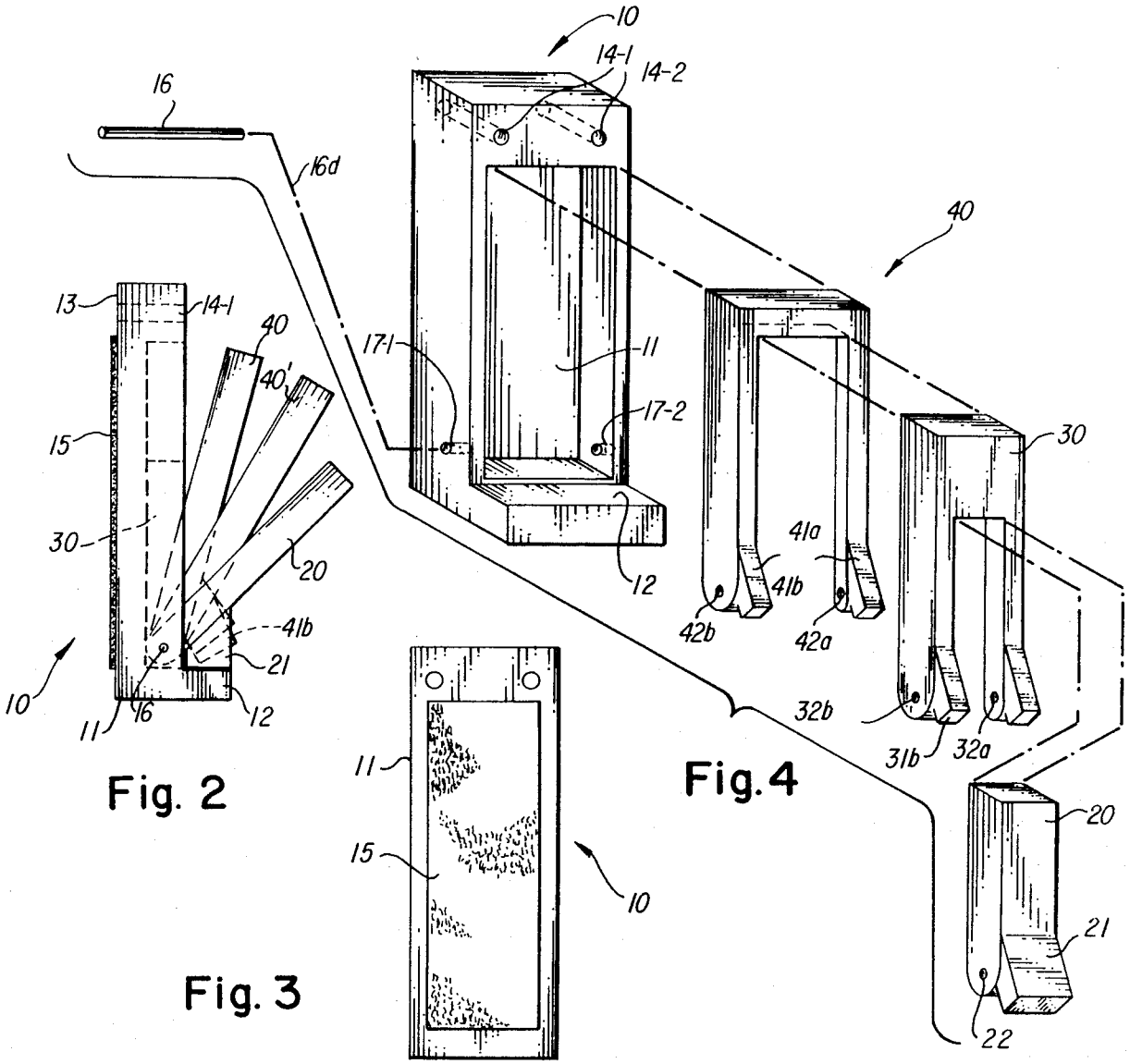
Fig. 4
Fig. 3
Fig. 2
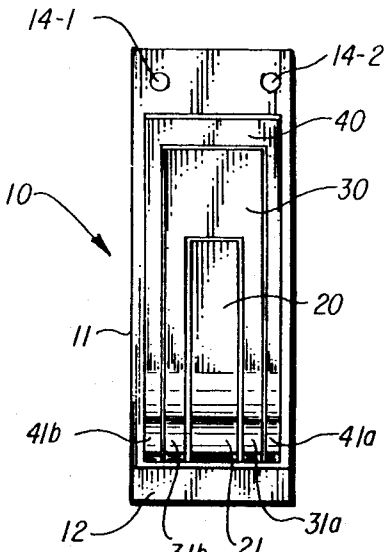
Fig. 1

SUSPENSION OF OBJECTS

BACKGROUND OF THE INVENTION

This invention relates to the suspension of objects, and more particularly, to the suspension of a multiplicity of objects or items at a single suspension position.

Objects and items are conventionally suspendable by hooks which have a fixed projection that extends outwardly from a mount. Conventional hooks have the objection of providing fixed projections that can be encountered accidentally and objectionably. This is particularly the case for hooks which are employed in close quarters where space is at a premium.

Similarly, where it is necessary to economize on space, it is usually necessary to provide a multiplicity of hooks for a corresponding multiplicity of items.

Moreover in some situations there is an aesthetic objection to the conventional hook and it is preferable to employ a hooking arrangement which is more acceptable to the overall decor that is desired.

Accordingly, it is an object of the invention to facilitate the suspension of items. A related object is to facilitate the suspension of a multiplicity of items at a single suspension position.

Still another object of the invention is to stabilize the suspension of one or more items at a single suspension position. A related object is to limit the extent to which a suspended item can be accidentally dislodged from its suspension position. Another related object is to limit the extend of accidental dislodgement for a multiplicity of items.

A further object of the invention is to provide for the suspension of items by an arrangement which is not readily identifiable as a hooking arrangement. A related object is to provide an arrangement for the hooking of items that has greater aesthetic acceptability than conventional hooking arrangements.

Yet another object of the invention is to provide an arrangement which is readily convertible from a non-hooking, non-suspension configuration to a hooking or suspension configuration.

An additional object of the invention is to provide a suspension arrangement which is easy and economical both to manufacture and install, as well as employ in practice.

SUMMARY OF THE INVENTION

In accomplishing the foregoing and related objects, the invention provides a longitudinally extending, or extendable, member that is pivotally positioned within a housing. The member includes a protuberence at the pivot position to facilitate the pivoting of the member outwardly from the housing into a position for receiving an item that is to be suspended by the member.

In accordance with one aspect of the invention, the housing is a frame with a rectangular opening that receives the longitudinally extending or extendable member. The latter desirably has a rectangular cross section in its longitudinal direction and is similar in its rectangularity to that of the opening in the housing within which it is pivotally positioned. The protuberence of the member at the pivot position is advantageously in the form of a pedestal which extends upwardly in the form of a ramp when the member is retracted within the opening of the housing. The ramp surface, which extends above the level of the housing, is readily engageable by a user, and when depressed, causes the opposite end of the member to pivot outwardly from the housing. This avoids the necessity of prying on the end of the member or seeking to engage the free end by grabbing the member within the housing opening.

In accordance with another aspect of the invention, a plurality of nested members are includable within the housing at the pivot position. In one form of nesting, a central member is bridged by adjoining legs which are in turn joined by the bridge. This configuration permits an item that is to be suspended to be trapped between the two members and thereby restricted from accidental dislodgement at the suspension position. In effect, the two suspension members, one bridged by the other, can be pivoted outwardly from the housing and used like a clamp to secure the item being suspended.

In accordance with yet another aspect of the invention, additional bridging members can be employed. It is particularly convenient for the arrangement to include at least three extendable or extending members. A central member has a rectangular cross section and is bridged by an inner member with side legs along the sides of the inner member and a bridging structure across the top. The latter is in turn bridged by a third member with legs similar to those of the inner member except for being longer to accommodate the central member and having a shallower bridge in order to again accommodate the bridge structure of the central member. It is advantageous for each leg of a pivotal member to include a control protuberence, and for the housing to be provided with an apron or ramp which is engaged by the end of the control protuberence when one or more of the suspension members are pivoted outwardly from the housing.

DESCRIPTION OF THE DRAWINGS

Other aspects of the invention will become apparent after considering several illustrative embodiments taken in conjunction with the drawings, in which:

FIG. 1 is a frontal view of a multiple suspension arrangement with nested suspension members retracted into a housing;

FIG. 2 is a side view of the arrangement of FIG. 1 showing the various suspension members in the course of being variously pivoted outwardly from their associated housing;

FIG. 3 is a rear view of the suspension arrangement of FIG. 1; and

FIG. 4 is an exploded view, in perspective, showing the constituents of the arrangement of FIG. 1.

DETAILED DESCRIPTION

With reference to the drawings, a multiple suspension device 10 is shown in FIG. 1 with suspension members 20, 30 and 40 shown retracted into the housing 11 of the device 10. Each of the retracted suspension members 20, 30 and 40 includes protuberences 21, 31*a*, 31*b*, 41*a* and 41*b* on appropriate end portions of the members to facilitate the pivoting of the members from their respective positions of retraction. Also indicated in FIG. 1 is the front view of a platform 12 which acts in conjunction with the various projections 21 through 41*a–b* when the members 20, 30 and 40 are extracted from their retracted positions of FIG. 1. The housing 11 also includes, at its upper end 13 a set of apertures 14-1 and 14-2 which can be used to facilitate the attachment of the device 11 to a wall surface.

As indicated in the side view of FIG. 2, the suspension device 11 can be primarily secured to a wall surface by an adhesive backing 15. The backing 15 is covered with a customary release sheet until such time as the device 11 is to be attached to a wall surface. Also as indicated in FIG. 2 the members 20, 30 and 40 are pivotally secured at the lower end of the housing 11 by a pin 16. The latter extends not only through the pivot ends of the members 20, 30 and 40 but also through the side walls of the housing 11. The specific disposition of the pin 16 with respect to the housing 11 is illustrated in the exploded view of FIG. 4, which indicates that the pin 16 is applied along the dash-dot line **16*d* to an aperture 17-1 in one side wall and then through a corresponding aperture 17-2** in the opposite said wall.

With reference again to FIG. 2, the inner member 20 is shown in its fully pivoted position with its protuberence 21 engaging the platform 12. It can be seen in FIG. 2 that the protuberence 21 is in the form of a ramp that extends upwardly at an angle of about 45° when the member 20 is fully retracted. This protuberence 21 facilitates the pivoting of the member 20 from the housing 11, by permitting pressure to be applied to the protuberence 21. Since the protuberence 21 is at an angle with respect to the extension surface of the member 20, there is a component of force applied to the pin 16 and a perpendicular component applied to the longitudinal axis of the member 20 that applies a torque to the member and readily causes the desired pivoting action. For that purpose the contact surface of the protuberence 21 that is engaged by the operator is positioned on the member 20 a sufficient distance from the pivot 16, less than half the length of the member 20 to provide the desired torque effect. The outer member 40 is shown in various positions of extraction from the housing 11. At the intermediate position 40' the corresponding protuberence **41*b* has not yet engaged the platform 12. It will be appreciated that the members 20 and 40 can be used to sandwich an object for suspension between them and help avoid accidental dislodgement of the suspended item. The central member 30 in FIG. 2 is still within the frame 11**, not having been pivoted outwardly into operating position.

In the rear view of FIG. 3 the adhesive backing 15 is shown with its protective covering removed so that the device 10 is ready to be mounted on an appropriate surface.

In FIG. 4 details of the members 20, 30 and 40 are given. The member 20 has a single leg while the nesting members 30 and 40 have straddling legs. In the case of the member 30 the side legs straddle the inner member 20, while in the case of the outer member 40 the side legs straddle the intermediate member 30. The members 30 and 40 have their legs bridged by an appropriate cross connecting element in each case. For the particular embodiment of FIGS. 1 and 4, the bridge for the member 30 is higher than the corresponding bridge for the member 40. It will be appreciated that specific bridging structure is a matter of design, and that modifications can be made in accordance with the desired interaction among the various members 20, 30 and 40.

While various aspects have been illustrated in the detailed description, it will be appreciated that the description is for illustration only and that various other modifications and adaptations can be made by those of ordinary skill in the art.

What is claimed is:

1. Apparatus for the suspension of objects which comprises a housing;

a longitudinally extendable member pivotally positioned within said housing; and means on said member above its pivot for facilitating the positioning thereof with respect to said housing and controlling the extent of pivoting;

said apparatus further including a second longitudinally extendable member directly adjoining and having the same pivotal connection as the first mentioned longitudinally extendable member;

wherein said second longitudinally extendable member is formed by two legs which straddle and directly adjoin said first longitudinally extendable member and are bridged together above the end of said first member.

2. Apparatus as defined in claim 1 wherein said housing forms a frame for said member which is completely includable therein except for the facilitating means.

3. Apparatus as defined in claim 2 wherein said housing has a rectangular opening for receiving said member which has a rectangular cross section in the longitudinal direction that is substantially coextensive with the rectangular opening of said housing.

4. Apparatus as defined in claim 1 further including a third longitudinally extendable member directly adjoining and with the same axis of pivot as said first and second members.

5. Apparatus as defined in claim 4 wherein said third longitudinally extendable member includes legs which slidingly straddle said second longitudinally extendable member and are joined together by a bridge which is positioned above the bridge of said second longitudinally extendable member.

6. Apparatus as defined in claim 1 wherein said member has a prescribed length which is less than the corresponding dimension of an opening within said housing which contains said member pivotally positioned therein.

7. Apparatus for the suspension of objects which comprises a housing;

a longitudinally extendable member pivotally positioned within said housing; and means on said member above its pivot for facilitating the positioning thereof with respect to said housing and controlling the extent of pivoting;

said apparatus further including a second longitudinally extendable member directly adjoining and having the same pivotal connection as the first mentioned longitudinally extendable member; and said second longitudinally extendable member including means above the pivot for facilitating the pivoting thereof.

8. Apparatus as defined in claim 7 wherein said facilitating means comprises a projection from said member that is trapezoidal in longitudinal cross section with planar outer and inner surfaces that join to said member, and an end surface that is perpendicular to the outer and inner surfaces.

9. Apparatus as defined in claim 8 wherein said member has a semicircular configuration at the end thereof associated with said pivot.

10. Apparatus as defined in claim 9 wherein said member includes a planar ramp projection that is elevated above the surface of said member within said housing.

11. Apparatus as defined in claim 10 wherein said projection forms a blunt end at an acute angle with respect to said member at the end thereof associated with said pivot.

12. Apparatus as defined in claim 11 wherein said projection is depressable into contact with a perpendicular apron of said frame to pivotally position said member outwardly from said frame and provide for the suspension of objects thereby.

13. Apparatus as defined in claim 7 wherein said second member includes a pair of legs which straddle said first member and means on each leg for facilitating the pivoting thereof.

14. Apparatus as defined in claim 7 wherein said housing has a rectangular opening for receiving said member which is similar to the rectangular opening of said housing and has a rectangular cross section with respect to its longitudinal extension.

15. The method of suspending objects which comprises the steps of:

(a) providing a longitudinally extendable member in accordance with claim 7;

(b) positioning said member pivotally within a housing; and (c) acting upon said member by applying intermediate torque at the pivot position thereof to pivot said member outwardly from said housing.

16. The method of claim 15 further including the step of providing a plurality of longitudinally extendable members within said housing.

17. The method of claim 15 further including the step of providing a protuberence at the pivot position of said member which is engageable by a user when said member is positioned with said housing, with only said protuberence extending therebeyond, thereby to permit said member to be pivoted outwardly from said housing into a position for receiving an object to be suspended by said member.

18. The method of fabricating apparatus for the suspension of objects which comprises the steps of:

(a) forming a housing having a rectangular opening therein;

(b) inserting a longitudinally extending member in accordance with claim 7 into said rectangular opening so that said member is within said housing except a single projection; and (c) pinning one end of said member to said housing.

* * * * *